US010889416B2

(12) United States Patent
Lucas, Jr. et al.

(10) Patent No.: US 10,889,416 B2
(45) Date of Patent: Jan. 12, 2021

(54) CHILD RESISTANT CONTAINER AND METHOD OF OPENING SAME

(71) Applicant: CSP TECHNOLOGIES, INC., Auburn, AL (US)

(72) Inventors: Franklin Lee Lucas, Jr., Opelika, AL (US); Brian Tifft, Auburn, AL (US); Ethan Ross Perdue, Auburn, AL (US); Kasey Myers, Auburn, AL (US); Jean-Pierre Giraud, Auburn, AL (US); Anthony Hamilton, Cullman, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 234 days.

(21) Appl. No.: 15/960,727

(22) Filed: Apr. 24, 2018

(65) Prior Publication Data

US 2018/0305093 A1 Oct. 25, 2018

Related U.S. Application Data

(60) Provisional application No. 62/489,032, filed on Apr. 24, 2017.

(51) Int. Cl.
*B65D 50/06* (2006.01)
*B65D 43/16* (2006.01)

(52) U.S. Cl.
CPC ..... *B65D 50/067* (2013.01); *B65D 43/162* (2013.01); *B65D 2251/1058* (2013.01);
(Continued)

(58) Field of Classification Search
CPC ..... B65D 50/067; B65D 43/162; B65D 2251/1058; B65D 2543/00296;
(Continued)

(56) References Cited

U.S. PATENT DOCUMENTS 1,316,515 A * 9/1919 Smith ..... B65D 50/068 215/215
4,126,224 A 11/1978 Laauwe et al.
(Continued)

FOREIGN PATENT DOCUMENTS

EP 0603090 A1 6/1994
EP 1582476 A1 10/2005
(Continued)

OTHER PUBLICATIONS

International Search Report for PCT/US2007/006693 dated May 26, 2008.
(Continued)

*Primary Examiner* — Thanh K Truong
*Assistant Examiner* — Katie L Gerth
(74) *Attorney, Agent, or Firm* — Mark T. Vogelbacker; Eckert Seamans Cherin & Mellott, LLC

(57) ABSTRACT

A child resistant container is for containing at least one product, such as medicine. The child resistant container includes a body, a lid, and a directing portion. The body has an end portion defining an opening leading to an interior of the body. The lid is connected to the body via a hinge, and includes a cover portion and a protrusion extending outwardly therefrom. The cover portion is configured to move between a FIRST position corresponding to the cover portion covering the opening, and a SECOND position corresponding to the cover portion not covering the opening. The directing portion extends from one of the body and the cover portion, and at least partially encloses the protrusion when the cover portion is in the FIRST position. When the cover portion moves from the FIRST position to the SECOND position, the protrusion moves away from the directing portion.

20 Claims, 8 Drawing Sheets

(52) U.S. Cl.
CPC ..... *B65D 2543/00074* (2013.01); *B65D 2543/00296* (2013.01); *B65D 2543/00324* (2013.01); *B65D 2543/00351* (2013.01); *B65D 2543/00537* (2013.01)

(58) Field of Classification Search
CPC ..... B65D 2543/00324; B65D 2543/00537; B65D 2543/00351; B65D 2543/00074
USPC ..... 53/492; 215/201, 215, 207, 224; 220/274, 284; 206/580, 540
See application file for complete search history.

(56) References Cited

U.S. PATENT DOCUMENTS 4,170,315 A 10/1979 Dubach et al.
4,244,495 A 1/1981 Lorscheid et al.
4,260,067 A 4/1981 Andruchiw
4,387,730 A 6/1983 Shioi
4,512,484 A 4/1985 Mar
4,746,008 A 5/1988 Heverly et al.
4,809,874 A 3/1989 Pehr
4,830,206 A * 5/1989 Fisher ..... 206/1.5
4,892,208 A 1/1990 Sledge
4,972,860 A 11/1990 Yuhara et al.
4,974,735 A 12/1990 Newell et al.
5,012,941 A 5/1991 Abrams et al.
5,031,784 A 7/1991 Wright
5,040,691 A 8/1991 Hayes et al.
5,083,671 A 1/1992 Hayes
5,137,260 A * 8/1992 Pehr ..... B65D 43/164 215/216
5,243,135 A * 9/1993 Shotey ..... H02G 3/14 174/67
5,270,011 A 12/1993 Altherr
5,353,946 A 10/1994 Behrend
5,427,265 A 6/1995 Cautereels et al.
5,526,953 A 6/1996 Chieng
5,577,626 A * 11/1996 Henkel ..... B65D 47/0804 215/237
5,577,779 A 11/1996 Dangel
5,579,957 A 12/1996 Gentile et al.
5,636,756 A 6/1997 Johnson
5,785,179 A 7/1998 Buczwinski et al.
5,819,967 A 10/1998 Lo
5,871,113 A * 2/1999 Conway ..... A47K 5/1202 220/210
5,908,037 A 6/1999 Pierson
5,911,937 A 6/1999 Hekal
6,036,036 A 3/2000 Bilani et al.
6,080,350 A 6/2000 Hekal
6,082,572 A 7/2000 Galton-Fenzi et al.
6,124,006 A 9/2000 Hekal
6,130,263 A 10/2000 Hekal
6,173,838 B1 * 1/2001 Brozell ..... B65D 77/02 206/472
6,174,952 B1 1/2001 Hekal et al.
6,176,381 B1 1/2001 Mader
6,214,255 B1 4/2001 Hekal
6,221,446 B1 4/2001 Hekal
6,398,067 B1 6/2002 Belfance et al.
6,486,231 B1 11/2002 Hekal
6,523,690 B1 2/2003 Buck et al.
6,613,405 B1 9/2003 Hekal
6,662,454 B2 12/2003 Harrold
6,772,902 B1 8/2004 White
6,902,080 B2 * 6/2005 Busch ..... B65F 1/1615 220/210
6,986,434 B1 1/2006 Getsy et al.
7,000,792 B2 * 2/2006 Arai ..... B65D 43/22 215/237
7,005,459 B2 2/2006 Hekal
7,213,720 B2 5/2007 Giraud
7,296,711 B2 11/2007 Hayakawa et al.
7,404,495 B2 7/2008 Keung
7,537,137 B2 5/2009 Giraud
7,581,656 B2 9/2009 Gnepper et al.
7,611,024 B2 11/2009 Yamanaka et al.
7,654,411 B2 * 2/2010 Boots ..... B65D 43/162 215/237
7,717,284 B2 5/2010 Giusti
7,721,907 B2 5/2010 Keung
7,735,665 B2 6/2010 Robinson
7,798,348 B2 9/2010 Sawyer
7,861,873 B1 * 1/2011 Bragg ..... B65D 50/046 215/237
8,051,998 B1 11/2011 Giraud et al.
8,141,731 B2 3/2012 Mazurkiewicz et al.
8,167,156 B2 5/2012 Milante
8,172,101 B2 5/2012 Giusti
8,235,233 B2 8/2012 Pehr
8,240,491 B2 8/2012 Beecroft et al.
8,292,101 B1 10/2012 Bragg et al.
8,292,110 B2 10/2012 Rutter et al.
8,317,052 B2 * 11/2012 Palmer ..... A22C 17/0093 220/274
8,469,212 B2 6/2013 Goto et al.
8,479,935 B2 7/2013 Straughan
8,528,778 B2 9/2013 Giraud
8,550,269 B2 10/2013 Lane
D696,078 S 12/2013 Allen
8,596,493 B2 12/2013 Vollers et al.
D732,684 S 6/2015 Ooi et al.
9,056,703 B2 6/2015 Brown et al.
9,352,889 B2 5/2016 Giraud et al.
2003/0102279 A1 * 6/2003 Michael ..... B65D 50/067 215/204
2003/0102323 A1 6/2003 Lohn
2005/0023285 A1 2/2005 Keung
2005/0115862 A1 * 6/2005 Maietta ..... B65D 83/0463 206/528
2005/0205607 A1 9/2005 Hierzer et al.
2005/0242105 A1 11/2005 Homann
2006/0006091 A1 * 1/2006 Maietta ..... B65D 83/0463 206/539
2006/0043100 A1 3/2006 Johnson et al.
2006/0049078 A1 * 3/2006 Sams ..... B65D 77/02 206/528
2006/0096984 A1 5/2006 Bandoh et al.
2006/0186077 A1 8/2006 Robinson
2007/0023317 A1 2/2007 Brozell et al.
2007/0170191 A1 7/2007 Arvidsson et al.
2007/0228042 A1 10/2007 Yeager
2008/0110933 A1 5/2008 Goncalves
2008/0169261 A1 7/2008 Druitt et al.
2008/0308568 A1 12/2008 Grenier et al.
2009/0045078 A1 * 2/2009 Gelardi ..... B65D 83/0463 206/1.5
2010/0012655 A1 * 1/2010 Dathy ..... B65D 43/0212 220/262
2010/0051572 A1 3/2010 Beecroft et al.
2010/0059471 A1 * 3/2010 Pehr ..... B65D 55/14 215/201
2011/0067363 A1 3/2011 Sprada et al.
2011/0114591 A1 * 5/2011 Giraud ..... B65D 50/045 215/224
2012/0055929 A1 3/2012 Hayton et al.
2013/0082059 A1 4/2013 Huang
2013/0320017 A1 * 12/2013 Kientzle ..... A61J 1/03 220/345.3
2015/0048088 A1 2/2015 Giraud et al.
2016/0130045 A1 * 5/2016 Giraud ..... A61J 1/1425 53/492

FOREIGN PATENT DOCUMENTS

EP 2050685 A1 4/2009
ES 2332979 2/2010
GB 2082552 A 3/1982
GB 2166423 A 5/1986
GB 2449505 A 11/2008
JP H0986550 A 3/1997
JP H09315455 A 12/1997

(56) References Cited

FOREIGN PATENT DOCUMENTS

| | | | |
|---|---|---|---|
| JP | 2003104429 | A | 4/2003 |
| WO | 9825836 | A1 | 6/1998 |
| WO | 2007065240 | A1 | 6/2007 |

OTHER PUBLICATIONS

Written Opinion for PCT/US2007/006693 dated Jun. 10, 2008.
International Preliminary Report on Patentability for PCT/US2007/006693 dated Sep. 23, 2008.

* cited by examiner

CHILD RESISTANT CONTAINER AND METHOD OF OPENING SAME

CROSS-REFERENCE TO RELATED APPLICATION

This application claims priority from and claims the benefit of U.S. Provisional Patent Application Ser. No. 62/489,032, filed Apr. 24, 2017, and entitled "CHILD RESISTANT CONTAINER RELEASED WITH CARD SWIPE".

FIELD OF THE INVENTION

The invention relates generally to child resistant containers that are configured to contain at least one product such as, for example and without limitation, pills and the like. The disclosed concept also relates to methods of opening child resistant containers.

BACKGROUND

Medication (e.g., without limitation, prescription and non-prescription pills) is often stored in containers. Flip-top containers, for example, which typically include a container body connected to a lid via a hinge, provide one reliable mechanism to store medication. However, known flip-top containers suffer from a number of disadvantages. Among those is that many of the containers are not particularly difficult to open. Why this is problematic is that if the containers can be opened too readily, then children might be able to inadvertently open them and gain access to the medication inside. Ingestion of the medication in even small doses by a child not intended to be the recipient of that medication could cause physical harm and even death. As such, there is a need for an improved child resistant container and method of opening the same.

SUMMARY OF THE INVENTION

Accordingly, in one aspect, there is provided a child resistant container for containing at least one product, such as medicine. The child resistant container includes a body, a lid, and a directing portion. The body has an end portion defining an opening leading to an interior of the body. The lid is connected to the body via a hinge, and includes a cover portion and a protrusion extending outwardly therefrom. The cover portion is configured to move between a FIRST position corresponding to the cover portion covering the opening, and a SECOND position corresponding to the cover portion not covering the opening. The directing portion extends from one of the body and the cover portion, and at least partially encloses the protrusion when the cover portion is in the FIRST position. When the cover portion moves from the FIRST position to the SECOND position, the protrusion moves away from the directing portion.

In another aspect, there is provided a method of opening the aforementioned child resistant container. The method includes the steps of inserting a tool between the directing portion and the cover portion, engaging the tool with the protrusion, thereby causing an end of the protrusion to pivot toward the cover portion, and moving the cover portion to the SECOND position, thereby opening the container.

In any embodiment, the tool is a separate component from the container itself (i.e., the tool is not attached to the container). Optionally, in any embodiment, the tool is a thin, substantially planar member such as a credit card or state issued identification (e.g., driver's license, for example). In this way, rather than requiring a special "key" that comes with the container, an adult user can open the container with an implement that adults typically have readily accessible, e.g., a credit card or the like.

BRIEF DESCRIPTION OF THE DRAWINGS

Exemplary embodiments of the present invention are shown in the enclosed drawings as follows.

DETAILED DESCRIPTION OF THE PREFERRED EMBODIMENTS

Figure 1:
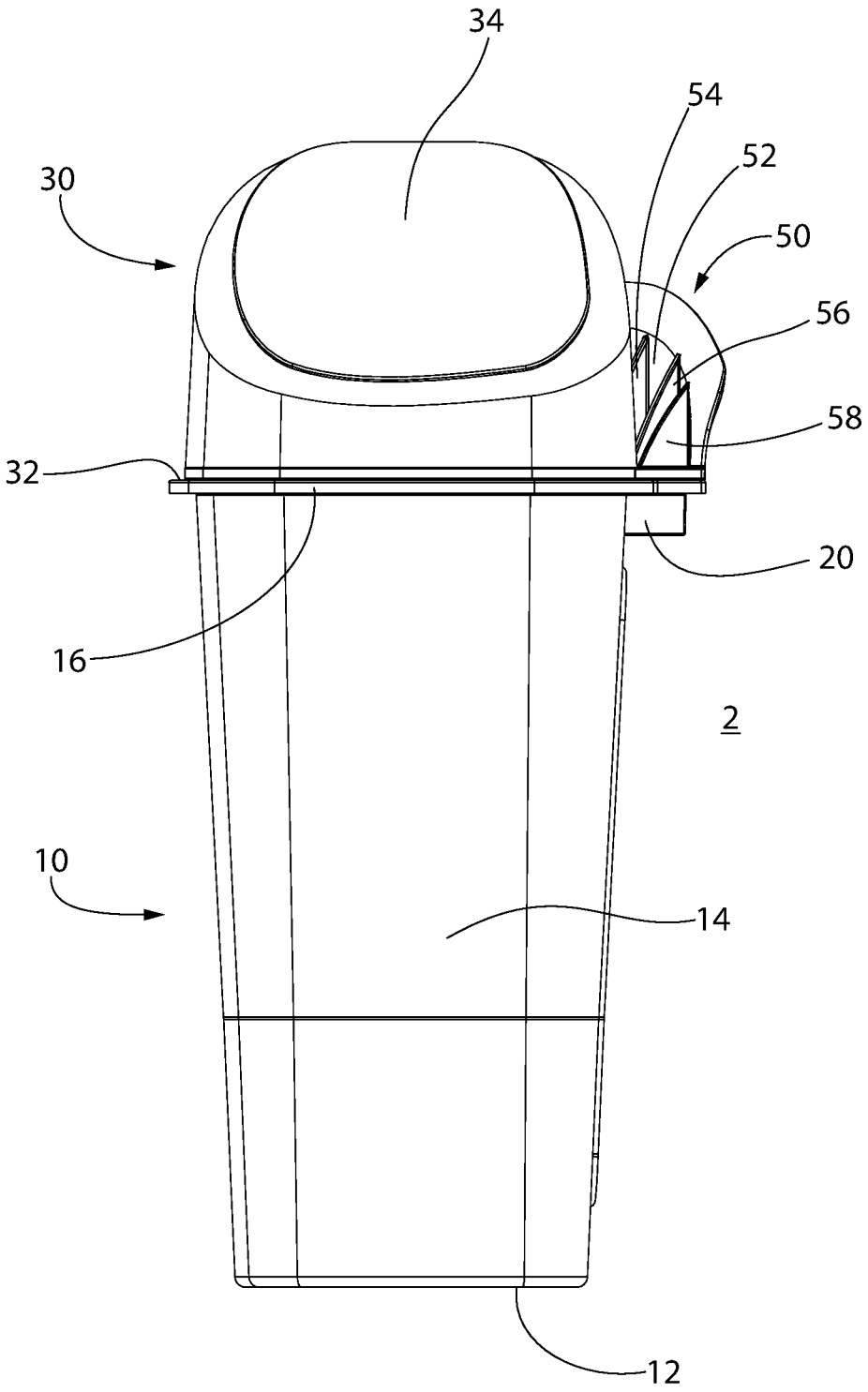
FIG. 1 is a front view of a child resistant container, in accordance with one non-limiting embodiment of the disclosed concept.
Figure 2:
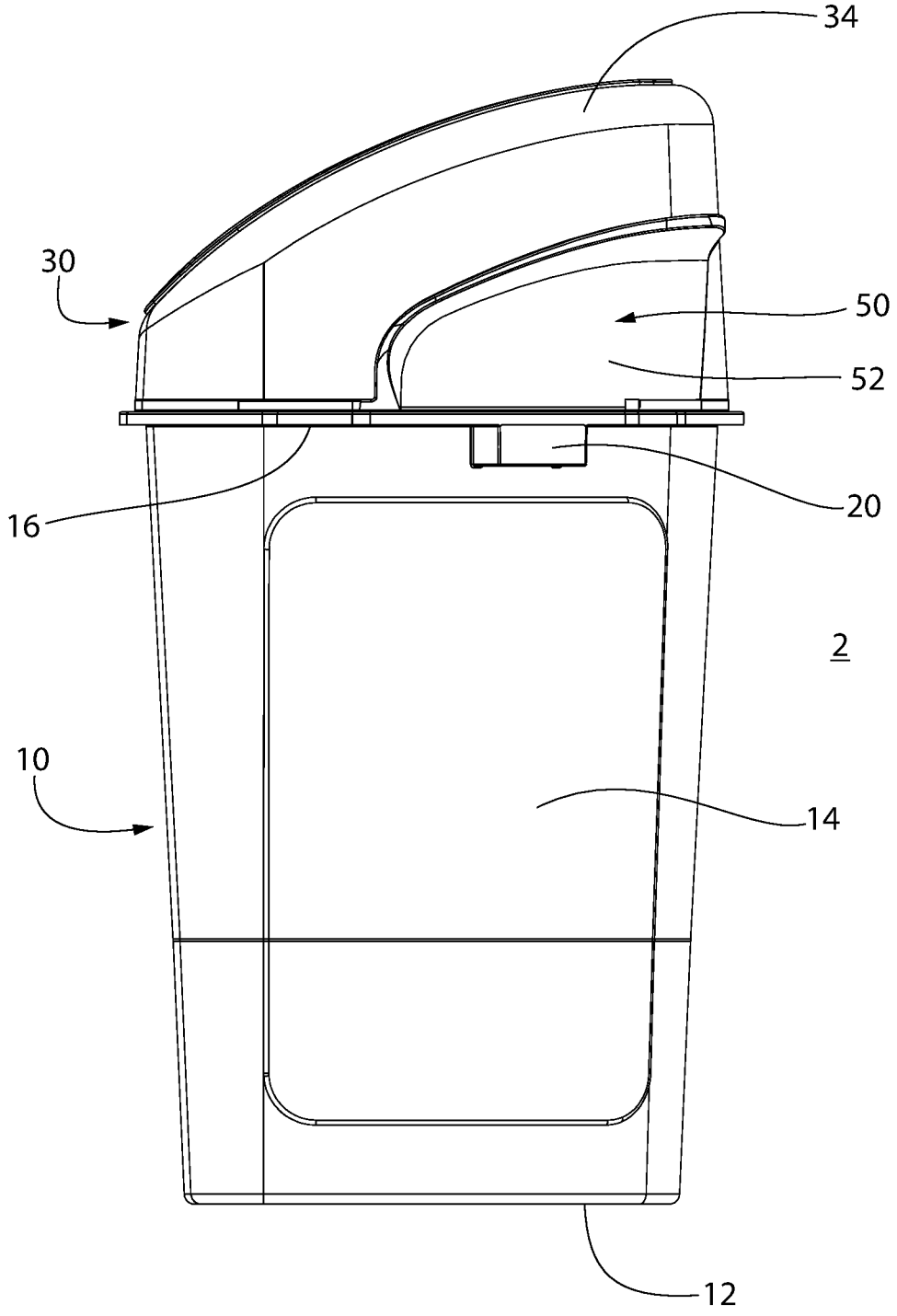
FIG. 2 is a right side view of the child resistant container of FIG. 1.
Figure 3:
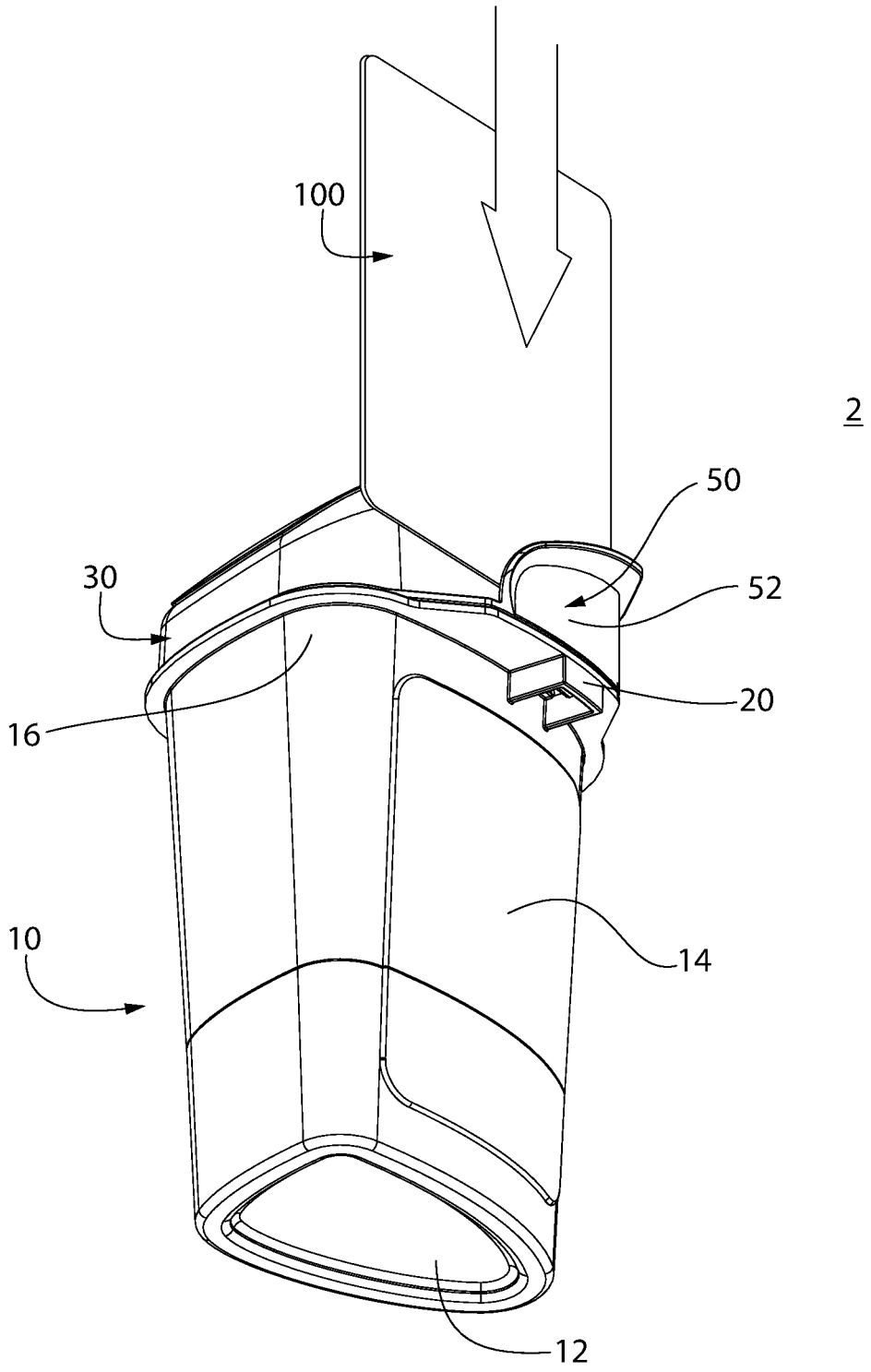
FIG. 3 is a front isometric view of the child resistant container of FIG. 1, shown with a tool partially inserted into the container.

As used herein, the word "unitary" means a component that is created as a single piece or unit. Under this definition, a component that includes pieces that are created separately and then coupled together as an assembled unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one.

FIGS. 1-8 show different views of a novel child resistant container 2, in accordance with one non-limiting embodiment of the disclosed concept. As will be discussed in greater detail below, container 2 includes a novel mechanism to be maintained in a closed position such that a child would not readily be able to open container 2, yet is still able to be easily opened by an adult to access the contents inside. In one example embodiment container 2 is a unitary component made from a single piece of material (e.g., without limitation, an injection molded piece). Alternatively, the container 2 may include a body that is separately molded form a lid, wherein the components are joined to each other by a hinge.

Container 2 includes a body 10, a lid 30 connected to body 10 via a hinge 32, and a directing portion 50. Body 10 has a base 12, a sidewall 14 extending from base 12, and an end portion 16 located opposite base 12. As shown most clearly in FIG. 5, end portion 16 defines an opening 17 leading to an interior 18 of body 10 for containing at least one product (e.g., medication such as pills).

Figure 4:
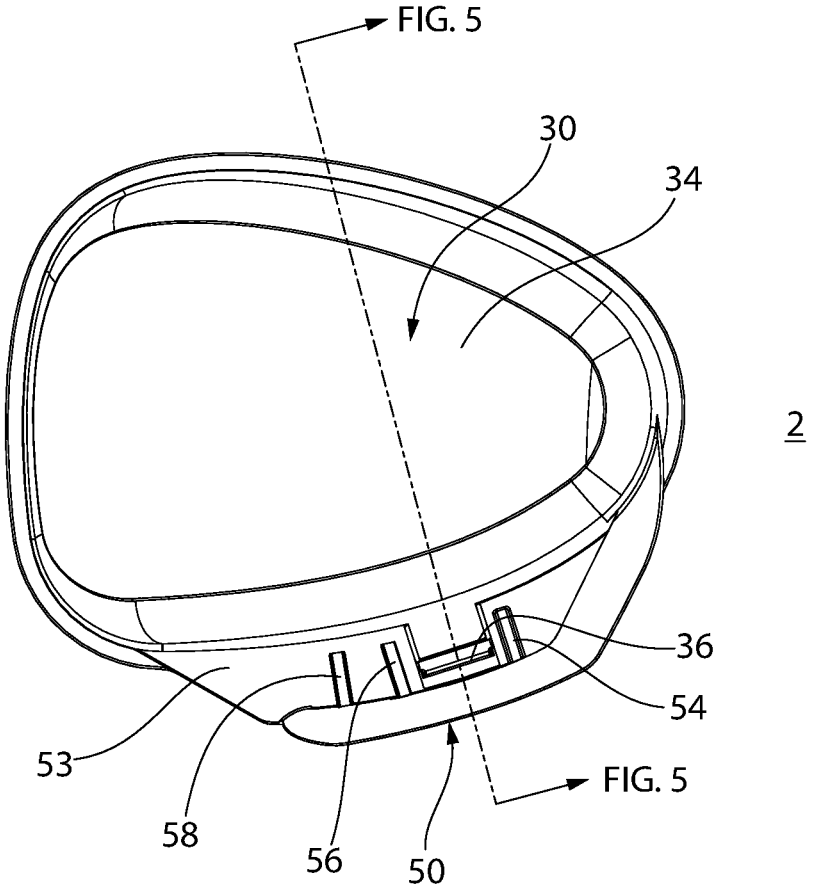
FIG. 4 is a top view of the child resistant container of FIG. 1.
Figure 5:
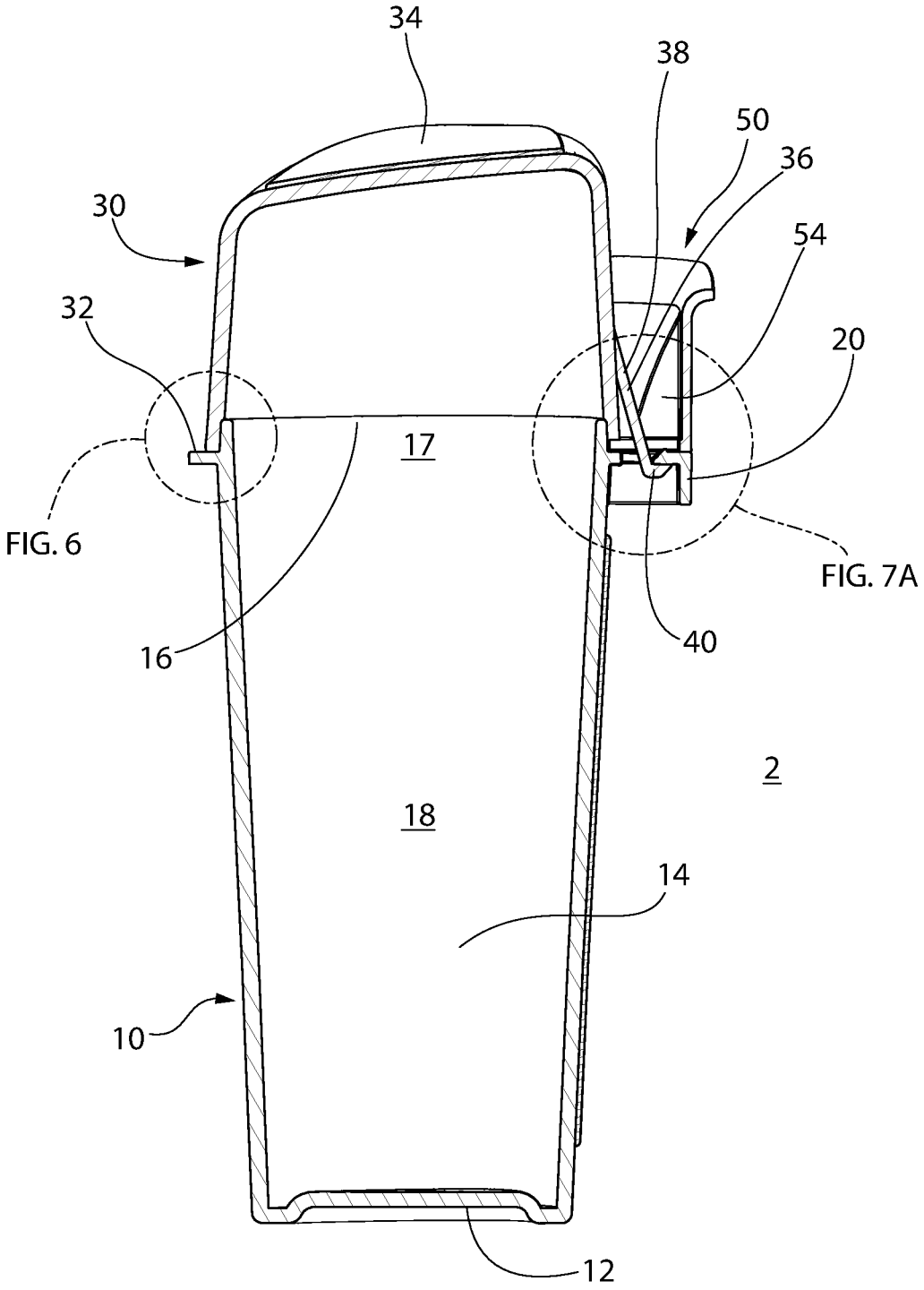
FIG. 5 is a section view of the child resistant container of FIG. 4.
Figure 6:
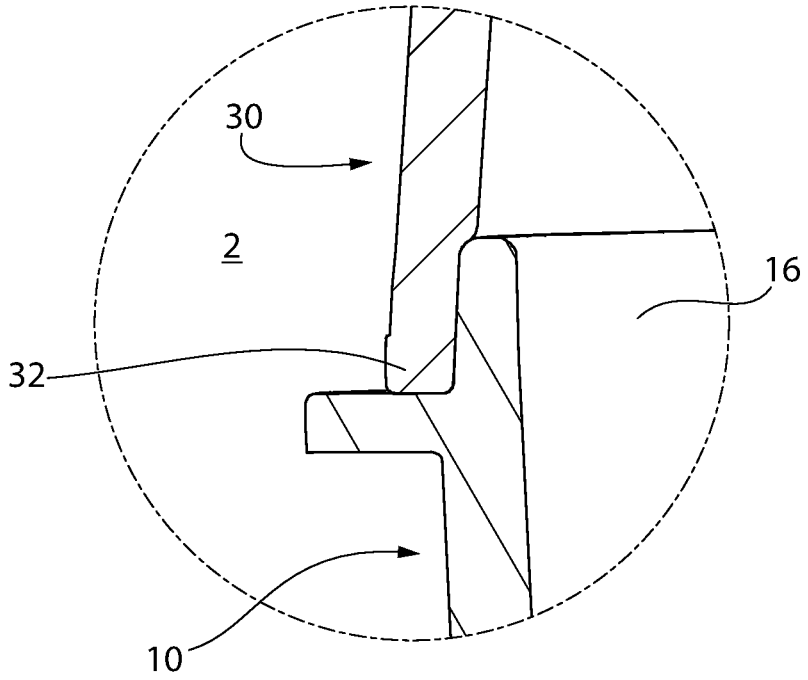
FIG. 6 is an enlarged view of a portion of the child resistant container of FIG. 5.
Figure 7A:
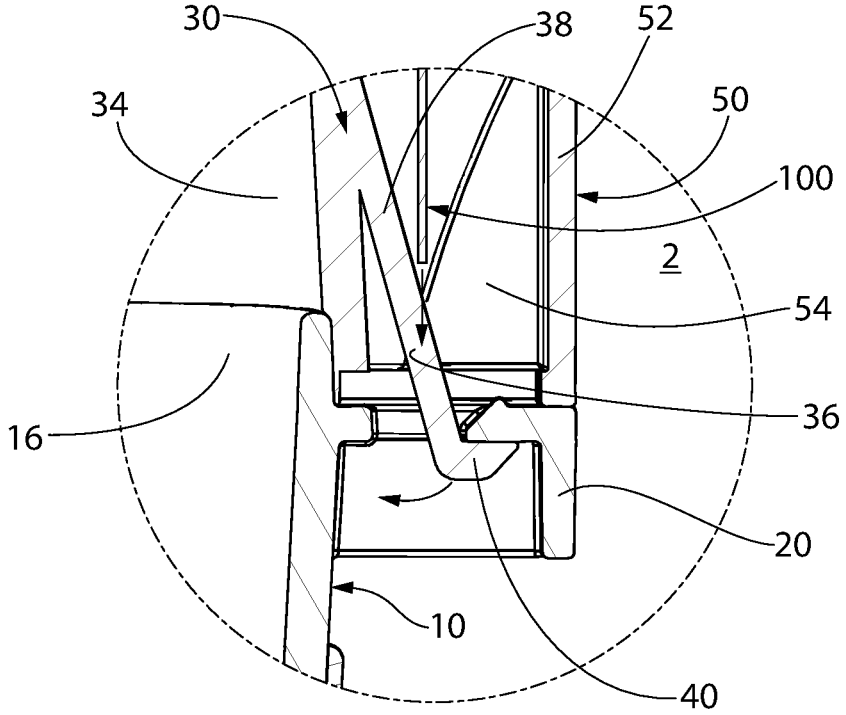
FIG. 7A is an enlarged view of another portion of the child resistant container of FIG. 5, shown with a tool partially inserted into the container.
Figure 7B:
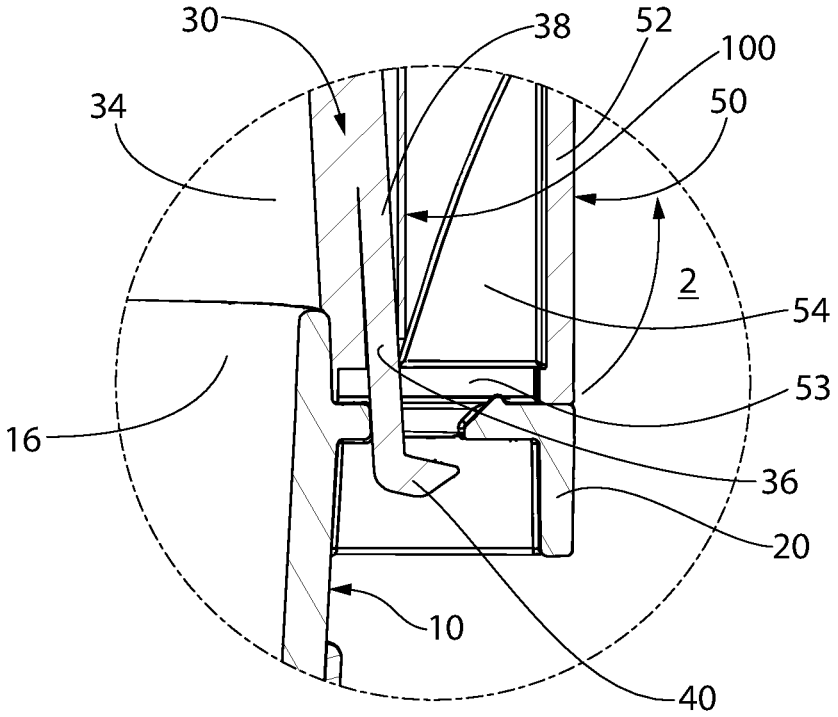
FIG. 7B shows the child resistant container of FIG. 7A, with the tool further inserted into the container.
Figure 7C:
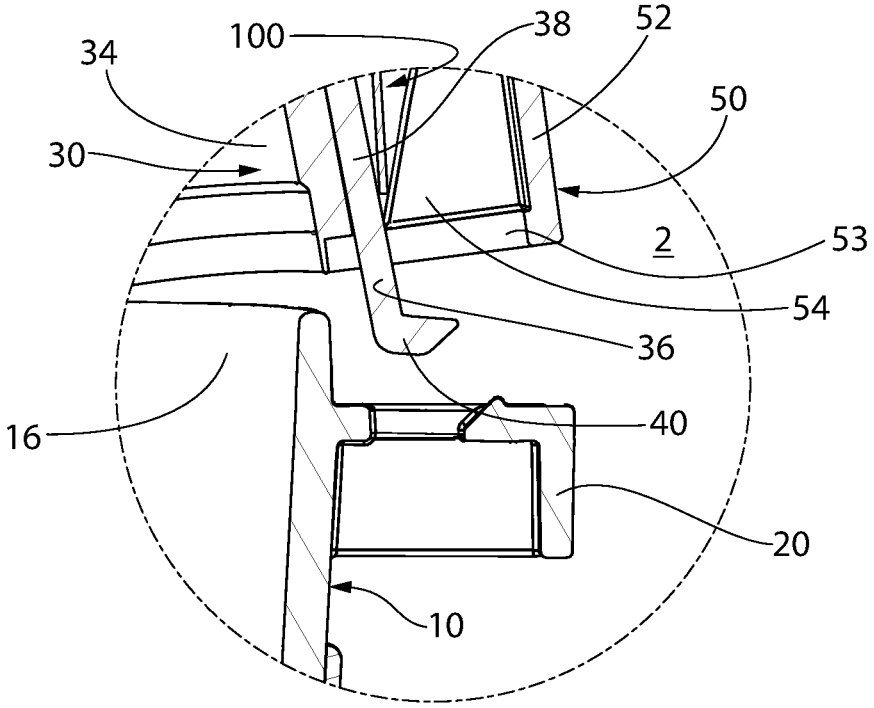
FIG. 7C shows the child resistant container of FIG. 7B, partially opened.
Figure 8:
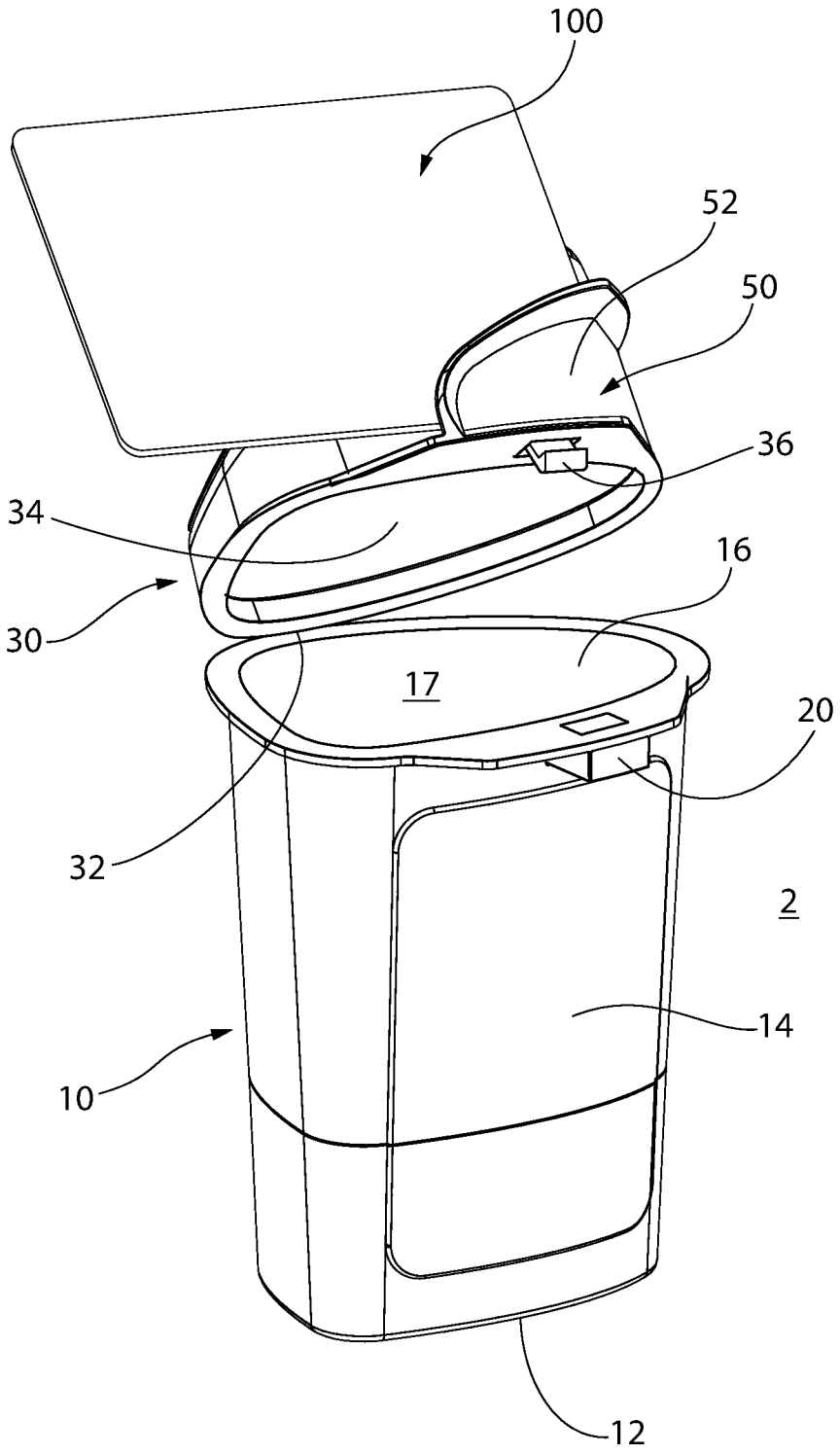
FIG. 8 shows an isometric view of the child resistant container of FIG. 1, shown with the container in an opened position.

Continuing to refer to FIG. 5, lid 30 includes a cover portion 34 and a protrusion 36 extending outwardly from cover portion 34. In one example embodiment, protrusion 36 and hinge 32 are substantially located on opposing sides of cover portion 34. Cover portion 34 is configured to move between a FIRST position (FIGS. 1-5) corresponding to cover portion 34 covering opening 17 (FIG. 5), and a SECOND position (FIG. 8) corresponding to cover portion 34 not covering opening 17.

In the example of FIGS. 1-8, directing portion 50 extends from cover portion 34. However, it will be appreciated that in a similar suitable alternative container, a directing portion may extend from a body of the container, without departing from the scope of the disclosed concept. Furthermore, as shown most clearly in FIG. 4, directing portion 50 at least partially encloses protrusion 36 when cover portion 34 is in the FIRST position.

In accordance with the disclosed concept, and in order to provide the aforementioned benefits associated with resistance to being opened by a child, when cover portion 34 moves from the FIRST position to the SECOND position, protrusion 36 moves away from directing portion 50. Specifically, protrusion 36 has a first end 38 and a second end 40. First end 38 extends from cover portion 34, and when cover portion 34 moves from the FIRST position toward the SECOND position, second end 40 pivots toward cover portion 34. Compare, for example, the position of protrusion 36 in FIGS. 7A (FIRST position) and 7B (wherein container 2 is partially moved toward the SECOND position). By moving protrusion 36 away from directing portion 50, cover portion 34 is advantageously able to be opened.

More specifically, as shown in FIGS. 5 and 7A-7C, body 10 further includes a latch portion 20 extending outwardly from sidewall 14. Latch portion 20 is located proximate end portion 16. When cover portion 34 is in the FIRST position (FIGS. 5 and 7A), protrusion 36 engages and is interlocked with latch portion 20. Furthermore, when cover portion 34 is in the FIRST position, protrusion 36 is biased toward engagement with latch portion 20 in order to maintain container 2 in the FIRST position. However, when cover portion 34 moves from the FIRST position toward the SECOND position, protrusion 36 disengages latch portion 20. See, for example, FIGS. 7B and 7C, in which protrusion 36 has disengaged latch portion 20.

In order to move protrusion 36 away from directing portion 50, it will be appreciated that simple insertion of a finger will generally not be sufficient, thus further providing benefits in terms of resistance to being opened by a child. Accordingly, directing portion 50 provides these benefits, optionally by including a primary wall portion 52, a secondary wall portion 53, and a number of rib portions 54,56,58 extending from primary wall portion 52 toward cover portion 34. Primary wall portion 52 preferably extends from cover portion 34 and is substantially concave facing cover portion 34. Secondary wall portion 53 extends outwardly from cover portion 34 and may be oriented substantially perpendicular to primary wall portion 52. Rib portions 54,56,58 each also extend from secondary wall portion 53. Each of rib portions 54,56,58 is also preferably spaced from cover portion 34, in order to allow protrusion 36 to be displaced away from directing portion 50, as will be discussed below.

Referring to FIG. 4, when cover portion 34 is in the FIRST position, protrusion 36 is located between first and second rib portions 54,56. It will, however, be appreciated that in a suitable alternative container, a protrusion may be located between other rib portions, and a suitable alternative directing portion may have greater or fewer than three rib portions.

As mentioned above, protrusion 36 cannot be readily displaced by simple insertion of a finger between cover portion 34 and directing portion 50. As such, and in order to further minimize the likelihood that a child could open container 2, container 2 is configured to be opened by a tool (e.g., without limitation, a credit card 100 or other suitable thin, substantially planar member, shown in FIGS. 3, 7A-7C, and 8). Accordingly, an adult, readily able to contemplate how to open container 2, will know that insertion of credit card 100 between primary wall portion 52 of directing portion 50 and cover portion 34 of lid 30 is a sufficient mechanism to cause cover portion 34 to move between the FIRST and SECOND positions.

More precisely, once credit card 100 is inserted, rib portions 54,56,58 will guide credit card 100 down toward engagement with protrusion 36. See, for example, the angle of rib portions 54,56,58. Continued pressing of credit card 100 will result in protrusion 36 being driven toward cover portion 34, thus releasing it from latch portion 20. Once protrusion 36 is released from latch portion 20, a user can simply move cover portion 34 to the SECOND position, as there would no longer be any obstruction to doing so.

It will thus be appreciated that container 2 provides a novel child-resistant mechanism to contain medicine (e.g., pills), while protecting children who might otherwise gain access to contents of a container. Specifically, adults will readily be able to understand that a motion of inserting a relatively thin tool (e.g., credit card 100) between primary wall portion 52 and cover portion 34 to deflect protrusion 36, and then moving cover portion 34 to the SECOND position will provide an opening into interior 18 and thus access to pills located therein. However, to most young children such a motion is not so simple, a feature which advantageously protects them from potentially ingesting the medicine.

Accordingly, a method of opening child resistant container 2 includes the steps of inserting a tool 100 between directing portion 50 and cover portion 34, engaging tool 100 with protrusion 36, thereby causing an end 40 of protrusion 36 to pivot toward cover portion 34, and moving cover portion 34 to the SECOND position, thereby opening container 2. As described herein, tool 100 is preferably a substantially planar member, and, as mentioned above, in one embodiment as provided as a credit card 100.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed:

1. A method of opening a child resistant container, the container comprising a body comprising a base, a sidewall extending from the base, and an end portion disposed opposite the base, the end portion defining an opening leading to an interior of the body configured to loosely contain a plurality of products therein, a lid connected to the body via a hinge, the lid comprising a cover portion and a protrusion extending outwardly from one side of the cover portion, the cover portion being configured to move between a FIRST position and a SECOND position; and a directing portion extending from one of the body and the cover portion, the directing portion at least partially enclosing the protrusion when the cover portion is in the FIRST position, the method comprising the steps of:

inserting a tool between the directing portion and the cover portion;

engaging the tool with the protrusion, thereby causing an end of the protrusion to pivot toward the one side of the cover portion; and moving the cover portion to the SECOND position, thereby opening the container.

2. The method according to claim 1, wherein the tool is a substantially planar member.

3. The method according to claim 1, wherein the body further comprises a latch portion extending outwardly from the sidewall; wherein the latch portion is disposed proximate the end portion; and wherein, when the cover portion is in the FIRST position, the protrusion engages and is interlocked with the latch portion; and wherein, when the cover portion moves from the FIRST position toward the SECOND position, the protrusion disengages the latch portion.

4. The method according to claim 3, wherein, when the cover portion is in the FIRST position, the protrusion is biased toward engagement with the latch portion.

5. The method according to claim 1, wherein the directing portion comprises a primary wall portion extending from the cover portion and is substantially concave on a side thereof that faces the cover portion.

6. The method of claim 1, wherein the tool is inserted between the directing portion and the cover portion in a direction generally parallel with a vertical axis of the body.

7. The method of claim 1, wherein the protrusion is located on an exterior surface of the lid.

8. The method of claim 1, wherein the plurality of products is completely enclosed by the container and the lid when the cover portion is in the FIRST position.

9. A method of opening a child resistant container configured to loosely contain a plurality of products such that the plurality of products is movable within the container, the method comprising:

inserting a tool between two portions of the child resistant container such that the tool engages a protrusion of a lid of the child resistant container, thereby causing an end of the protrusion to pivot toward a side of the lid from which the protrusion depends; and moving the lid from a closed position to an open position, thereby opening the container.

10. The method of claim 9, wherein the container loosely contains the plurality of products and the plurality of products is medication or pills.

11. The method of claim 10, wherein one of the two portions is a direction portion, and wherein the direction portion at least partially encloses the protrusion.

12. The method of claim 10, wherein the lid is connected to a body of the container by a hinge.

13. The method of claim 10, wherein the tool is a credit card or an identification card.

14. The method of claim 10, wherein pressing the tool against the protrusion causes the protrusion to be released from a latch portion.

15. The method of claim 14, wherein the lid cannot move from the closed position to the open position when the protrusion engages the latch portion.

16. The method of claim 10, wherein a portion of the direction portion is concave.

17. The method of claim 1, wherein the body loosely contains the plurality of products and the plurality of products is medication or pills.

18. The method of claim 10, wherein the tool is inserted between the two portions of the child resistant container in a direction generally parallel with a vertical axis of the body.

19. The method of claim 10, wherein the protrusion is located on an exterior surface of the lid.

20. The method of claim 10, wherein the plurality of products is completely enclosed by the container and the lid when the cover portion is in the FIRST position.

* * * * *